US009393582B2

(12) United States Patent
Goettke

(10) Patent No.: US 9,393,582 B2
(45) Date of Patent: Jul. 19, 2016

(54) DISPENSER FOR DELIVERING LIQUID TO PASTY MASSES

(75) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 340 days.

(21) Appl. No.: 14/127,226

(22) PCT Filed: Mar. 21, 2012

(86) PCT No.: PCT/EP2012/054952

§ 371 (c)(1),
(2), (4) Date: Jun. 24, 2014

(87) PCT Pub. No.: WO2012/126928

PCT Pub. Date: Sep. 27, 2012

(65) Prior Publication Data

US 2014/0305971 A1 Oct. 16, 2014

(30) Foreign Application Priority Data

Mar. 24, 2011 (DE) ..... 20 2011 000 682 U

(51) Int. Cl.

*B67D 7/58* (2010.01)
*B65D 88/54* (2006.01)
*B05B 11/00* (2006.01)

(52) U.S. Cl.

CPC ..... *B05B 11/0008* (2013.01); *B05B 11/3001* (2013.01); *B05B 11/3053* (2013.01); *B05B 11/3073* (2013.01); *B05B 11/3047* (2013.01); *B05B 11/3074* (2013.01)

(58) Field of Classification Search

CPC ..... B05B 11/0008; B05B 11/3001; B05B 11/3021; B05B 11/3023; B05B 11/3042; B05B 11/3047; B05B 11/3053; B05B 11/3073; B05B 11/3074

See application file for complete search history.

(56) References Cited

U.S. PATENT DOCUMENTS 6,955,278 B2 * 10/2005 Lorscheidt ..... B05B 11/007 222/320
6,966,465 B2 * 11/2005 Kang ..... B05B 11/3001 222/321.7
8,028,862 B2 * 10/2011 Rossignol ..... B05B 11/3004 222/256
8,245,884 B2 * 8/2012 Byeon ..... B05B 11/3053 222/256
9,101,951 B2 * 8/2015 Goettke ..... B05B 11/3001
9,114,416 B2 * 8/2015 Byeon ..... B05B 11/3052

(Continued)

FOREIGN PATENT DOCUMENTS

DE 20 2008 011 730 U1 10/2009

OTHER PUBLICATIONS

International Search Report of PCT/EP2012/054952, Oct. 31, 2012.

(Continued)

*Primary Examiner* — Nicholas J Weiss
(74) *Attorney, Agent, or Firm* — Collard & Roe, P.C.

(57) ABSTRACT

A dispenser for delivering liquid to pasty masses has a pump unit, which has a restoring spring (25), and a discharge part (15) which forms a discharge tube (16), wherein the discharge tube (16) has a dispensing opening (17) which opens laterally to a dispenser longitudinal axis (A) extending in the pump direction, wherein furthermore a closure part (18) can be moved between a closed position and an open position in the discharge tube (16) in order to close the dispensing opening (17). An additional opening (20) is formed further up in the discharge part (15), which opening opens in the direction of the longitudinal axis (A) and is closed by a latching part (21).

17 Claims, 4 Drawing Sheets

(56) References Cited

U.S. PATENT DOCUMENTS

2005/0006411 A1* 1/2005 Kuwahara ..... B05B 11/3053 222/321.1
2007/0221686 A1* 9/2007 Bae ..... A45D 34/02 222/409
2008/0264975 A1* 10/2008 Bruder ..... B05B 11/0067 222/321.3
2009/0272765 A1* 11/2009 Seki ..... B05B 11/3053 222/321.3
2014/0144945 A1* 5/2014 Jung ..... B05B 11/0032 222/320

OTHER PUBLICATIONS

English translation of the International Preliminary Report on Patentability and Written Opinion of the International Searching Authority of PCT/EP2012/054952, Sep. 24, 2013.
Specification of U.S. Appl. No. 14/127,628, filed Apr. 8, 2014.
DE 20 2011 000 632.8 filed Mar. 21, 2011 (priority application of U.S. Appl. No. 14/127,628).

* cited by examiner 37
36
33
18
37
38
20
16
27
34
38
33
35
17
31
15
29
28
39
32
32
26

DISPENSER FOR DELIVERING LIQUID TO PASTY MASSES

CROSS REFERENCE TO RELATED APPLICATIONS

This application is the National Stage of PCT/EP2012/054952filed on Mar. 21, 2012 which claims priority under 35 U.S.C. §119 of German Application No. 20 2011 000 682.4 filed on Mar. 24, 2011, the disclosure of which is incorporated by reference. The international application under PCT article 21(2) was not published in English.

The invention relates to a dispenser for discharging liquid-to-pasty compositions, having a pump chamber with a restoring spring and a discharge part which forms a discharge tube, the discharge tube having a dispensing opening which opens laterally with respect to a dispenser longitudinal axis extending in the pump direction, and furthermore a closure part being movable between a closed position and a release position in the discharge tube for closing the dispensing opening.

Such a dispenser is known from DE 20 2008 011 730 U1, for example. The content of this publication is hereby included in full in the disclosure of the present application, including for the purpose of incorporating one or more of the features disclosed in the cited publication in claims of the present application. In addition, reference is made to German Utility Model Application 20 2011 000 632.8, not previously published. The content of this application is also hereby included in full in the disclosure of the present application, also for the purpose of incorporating one or more of the features disclosed in the cited application in claims of the present application.

In the dispenser known from the cited publication, in addition to the discharge opening, the discharge tube also has an opening at its end opposite from the discharge opening. In addition, there is also an opening at the bottom with respect to a connection to the pump chamber.

Against this background, it is an object of the invention to design the dispenser favorably in particular from the standpoint of manufacturing.

According to a first inventive concept, one possible approach to achieving this object is provided via a dispenser, which is based on the fact that an additional opening which opens at the top in the direction of the longitudinal axis is formed in the discharge part and is closed by a detent part. This is an additional opening in particular with respect to an opening which is preferably provided for connection to the pump chamber. Due to the fact that the mentioned additional opening is provided, manufacturing may be carried out in a favorable manner. In this regard, a continuous core, for example, may be used. On the other hand, this additional opening is also advantageous solely from the standpoint (but at least additionally) that this makes it possible to establish a favorable connection to a surrounding dispenser part.

Additional features of the invention are described and illustrated below, also in the description of the figures and the drawings, often in their preferred association with the concept already explained above, but they may also be important in association with only one or more individual features which are described here or illustrated in the drawings, or independently or in another overall concept.

It is thus preferable for the dispenser to have a dispensing cap which engages over the discharge part. In this way, the mentioned second opening and the detent part may be covered in a favorable manner. Thus, in this regard there is no objectionable appearance for the user.

It is also preferable that the dispenser cap forms the detent part which closes the second opening. No separate detent part is required for the second opening. Furthermore, favorable assembly between the discharge part and the dispensing cap is made possible.

Furthermore, it is also preferable for the second opening to be formed above the closure part. In a cross-sectional representation, the closure part extends beneath the second opening. With regard to a vertical connection between the second opening and the opening forming the access to the pump chamber, it is also preferable that the closure part extends at an angle, approximately at an acute angle, optionally also at a right angle in a special case, with respect to a connecting axis connecting the midpoints of this opening.

In addition, it is also preferable for the second opening, possibly with the exception of a detent bulge that protrudes inwardly, to have an inside diameter that matches the inside diameter of the discharge part beneath the closure part. This inside diameter of the discharge part beneath the closure part is the inside diameter of the connection formation to the pump chamber. The discharge part and/or the second opening or a connecting portion in this regard is/are preferably a cylindrical part. Due to the mentioned matching formation, a favorable configuration with regard to manufacture is achieved in particular, namely, with regard to a required core in the injection mold.

The subject matter of the invention also involves a dispenser for discharging liquid-to-pasty compositions, having a restoring spring, a pump chamber, and a discharge part which forms a discharge tube and has a dispensing opening, wherein furthermore a closure part is mechanically positively controlled by means of a stationary dispenser part between a closed position and a release position for closing the dispensing opening in the discharge tube.

With regard to the prior art, reference is made to the prior art already cited in the introduction, also to the inclusion of the previously known and older documents cited there. This inclusion is also made in the same way with regard to the subject matter further described here.

The mechanical control by means of a stationary dispenser part is in need of improvement with regard to the structural placement, also taking into account the additional components of the dispenser, in particular the restoring spring.

With regard to achieving the stated object, the invention provides an advantageous arrangement with regard to the stationary dispenser part for mechanically moving the closure part in the course of a pump movement.

According to a first concept of the invention, one possible approach to achieving this object is provided with a dispenser in which the restoring spring is situated on the outside with respect to the stationary dispenser part which provides the sliding block guide. Due to the fact that the stationary dispenser part is situated on the inside with respect to the restoring spring, a comparatively small lateral distance from the direction of movement of the closure part can be achieved with respect to the sliding block guide. A compact design of the dispenser is possible. This also results in an advantageous assembly option.

Additional features of this additional subject matter of the invention are described and illustrated below, also in the description of the figures and the drawings, often in their preferred association with the concept already described above. However, they may also be important in association with only one or more of the individual features which are described here or illustrated in the drawings, or independently in another overall concept.

It is thus preferable that the positive control is provided by an interaction of one or more sliding blocks with one or more slide guides. The interaction by means of sliding blocks and slide guides also permits favorable assembly, for example, a snap-on assembly.

It is also preferable that the stationary dispenser part forms a guide part for the restoring spring. The stationary dispenser part is thus utilized at the same time for aligning and guiding the restoring spring. The restoring spring may be allowed to drop as it were onto the stationary dispenser part during assembly.

In this context in particular, it is preferable that the stationary dispenser part has a cylindrical portion. The coil shape of the restoring spring is also preferably formed corresponding to a cylindrical or conical body, for example. The conical body may also be designed to widen toward the top, for example.

A cylindrical portion of the stationary dispenser part may at least partially form a guide surface for the restoring spring.

The cylindrical portion may merge at the bottom into an outwardly protruding flange. This permits a stable support position. Furthermore, centering within an outer dispenser part may be achieved at the same time by means of the flange.

Furthermore, the flange may preferably form a support surface for the restoring spring. The restoring spring is thus supported only on the stationary dispenser part, which also forms the slide guide.

The stationary dispenser part may have a flange extending radially inwardly at the top. In a further preferred design, the sliding guide may be supported on this flange for displacing the discharge tube. The sliding guide may also preferably be designed to be integral therewith, i.e., in particular by integral molding by injection molding. In comparison with a (lower) cylindrical diameter and/or a region forming the guide portion, the slide guide may then once again be formed to be offset radially inwardly.

Furthermore, it is preferable for the restoring spring to act at the top on the dispenser head, which comprises the discharge tube and which can be displaced vertically for pump movement. The restoring spring may be supported at the same time on the upper dispensing head with an overhang or at a lateral distance from the mentioned sliding block formation.

The dispensing head may have a through opening for the stationary dispenser part. A sliding block part may preferably pass through the through opening.

In addition, it is also preferable for the sliding block part to be formed or integrally molded on the radially inwardly extending flange of the stationary dispenser part.

The invention is explained in greater detail below on the basis of the accompanying drawings, which illustrate only one exemplary embodiment, in which.

Figure 1:
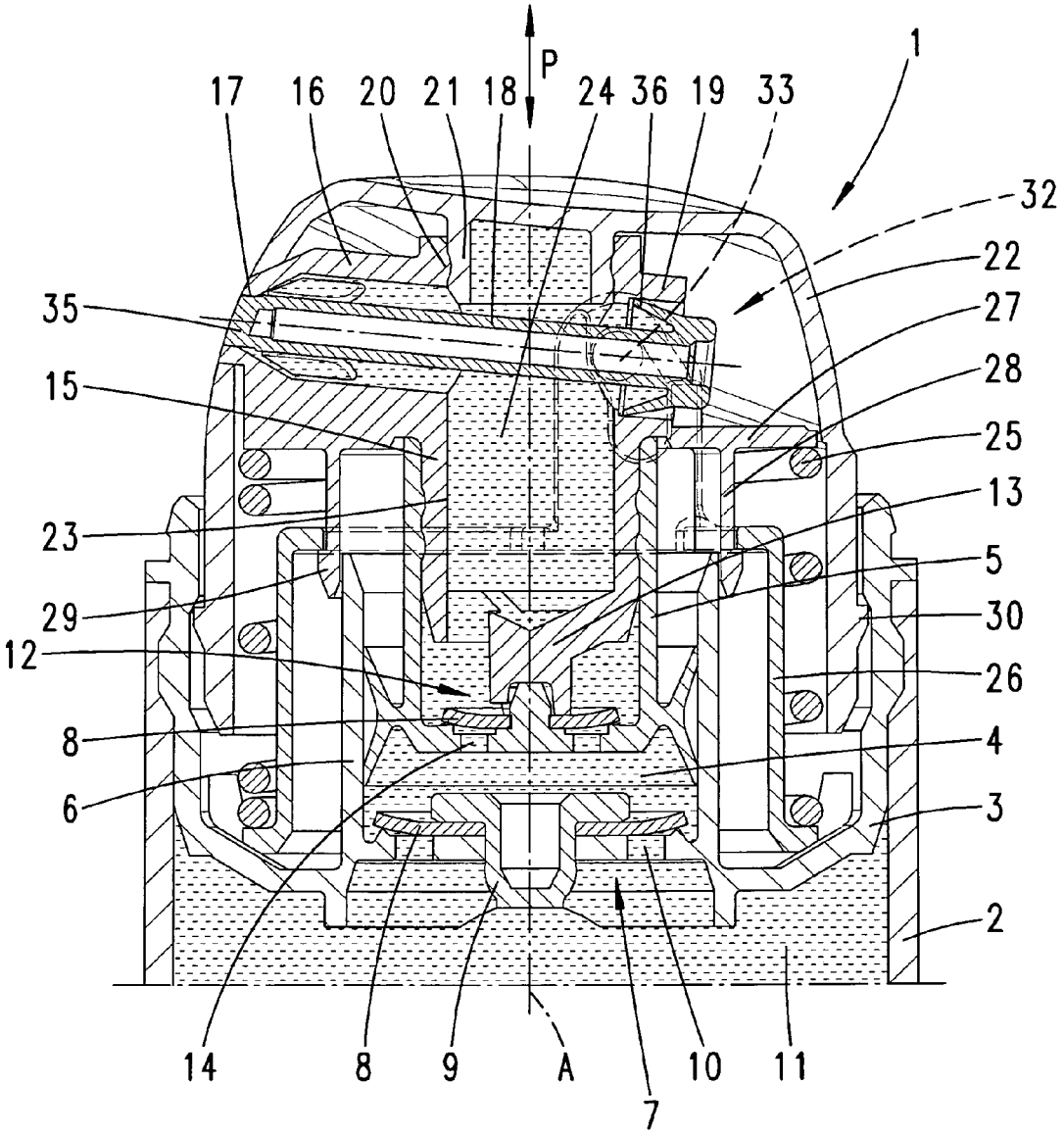
FIG. 1 shows a cross-section through the dispenser in the upper region in the rest position.

The upper part of a dispenser 1 is illustrated and described, essentially comprising a storage container 2 in which the pump unit is also secured at the top, namely, secured by latching, and the pump unit is covered by a dispenser cap 22.

In the pump unit, which in first instance has a lower part 3, a pump chamber 4 is formed which has a pump plunger 5 and a chamber wall 6 which is stationary with respect to the pump plunger.

An inlet valve 7 is formed at the lower end of the chamber wall 6. This is a diaphragm valve having a valve diaphragm 8. The valve diaphragm 8 is secured in the wall by means of a stopper part. The wall is also provided with openings 10, which are covered at the top by the valve diaphragm 8. A composition can be drawn out of the storage space 11 and into the pump chamber 4 through the openings 10. An outlet valve 12 is formed in the pump plunger 5, likewise comprising a valve diaphragm 8 that is secured by means of a holding part 13. Outlet openings 14 which are covered by the mentioned diaphragm at the top are also formed here.

In the illustrated exemplary embodiment, the holding part 13 is formed so as to merge into a discharge part 15. A discharge tube 16 in the discharge part 15 is provided with a dispensing opening 17. The dispensing opening 17 is open at the side, relative to a dispenser longitudinal axis A extending in the pump direction P. The region of the discharge part 15 forming the discharge tube 16 extends at an acute angle, almost at a right angle, with respect to the connecting portion which protrudes into the pump plunger part.

Figure 2:
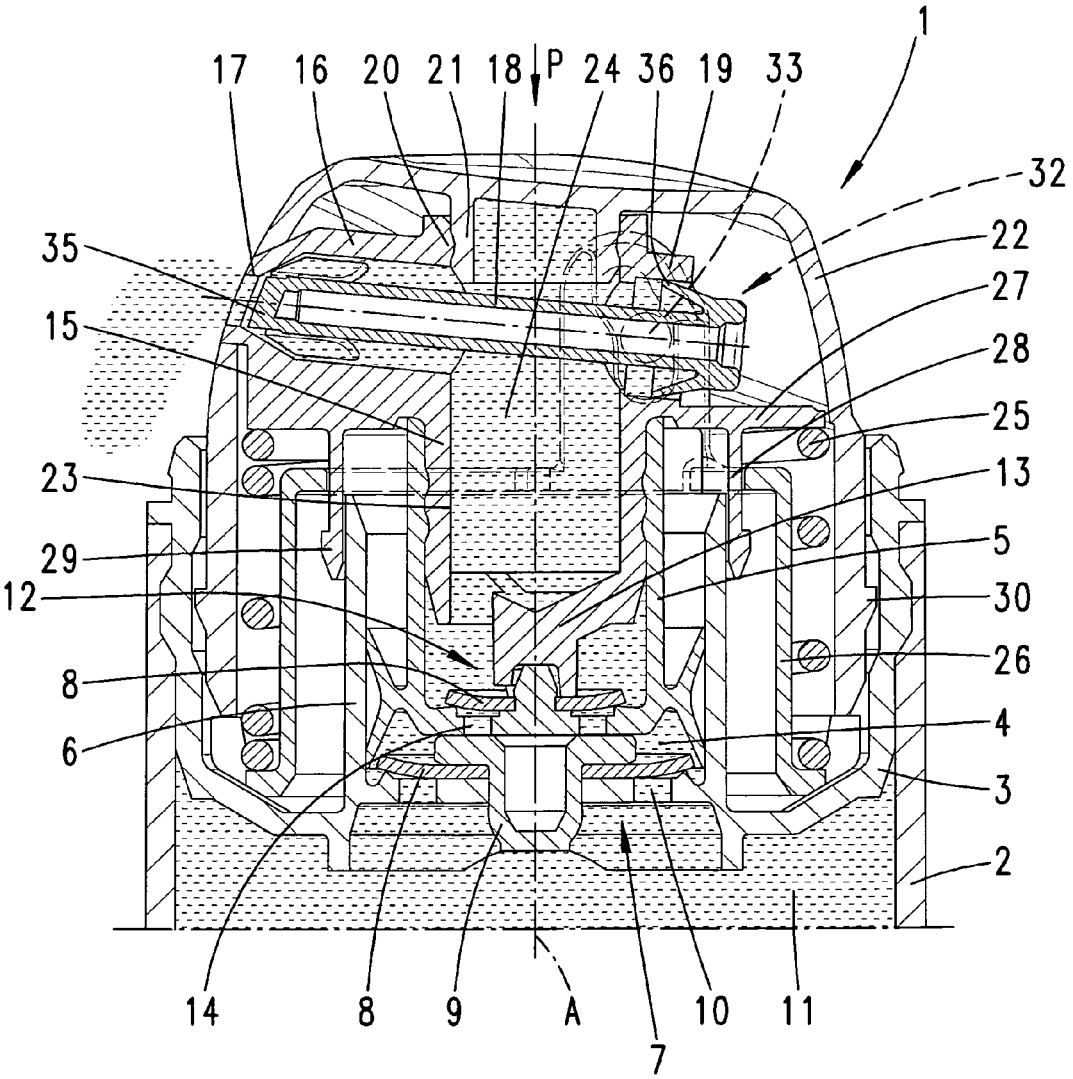
FIG. 2 shows an illustration according to FIG. 1 in the dispensing position.

A closure part 18 is provided for closing the dispensing opening 17. The closure part 18 is movable between a closed position according to FIG. 1 and a release position according to FIG. 2. This movement is accomplished due to an increase in pressure in the discharge part 15 as a result of pressing down on the discharge part 16 in the course of pump activation.

An insertion opening 19 is formed on the discharge part 15 or on the discharge tube 16, opposite the dispensing opening 17.

In addition, the discharge part 15 has an additional opening 20 which is closed by a detent part 21. In this exemplary embodiment and preferably, the detent part 21 is formed in one piece with a dispenser cap 22.

A tube part 23 which forms the path for the composition into the discharge tube 16 is formed on the discharge part 15, aligned with the additional opening 20 in the vertical direction. An opening 24 in this regard forms the transition of the tube part 23 to the discharge tube 16.

The additional opening 20 is situated above the closure part 18. The detent part 21 forms a type of blind connection at its insertion region into the additional opening 20.

A restoring spring 25, which acts between the part 3 or a guide part 26 supported thereon and the discharge part 15, is also provided. Within the scope of the present patent application, the guide part 26 is also referred to as a stationary dispenser part. For support with respect to the supporting spring 25, the discharge part 15 has a radially protruding flange portion 27, whose underside forms a supporting surface for the restoring spring 25. The holding portion 28, which protrudes further from the underside of the flange portion 27, holds the discharge part 15 on the guide part 26. To this end, retaining lugs 29, for example, are provided on the holding portion 28. In this regard, this may also be a circumferential protrusion. The retaining lugs interact with an inwardly protruding upper flange of the guide part 26. This is preferably also the flange on which the also upwardly protruding sliding block formations 32 are provided.

In addition, the dispenser cap 22 is correspondingly held on the part 3 by an outwardly facing holder protrusion 30 to prevent it from being pulled off after assembly.

Figure 3:
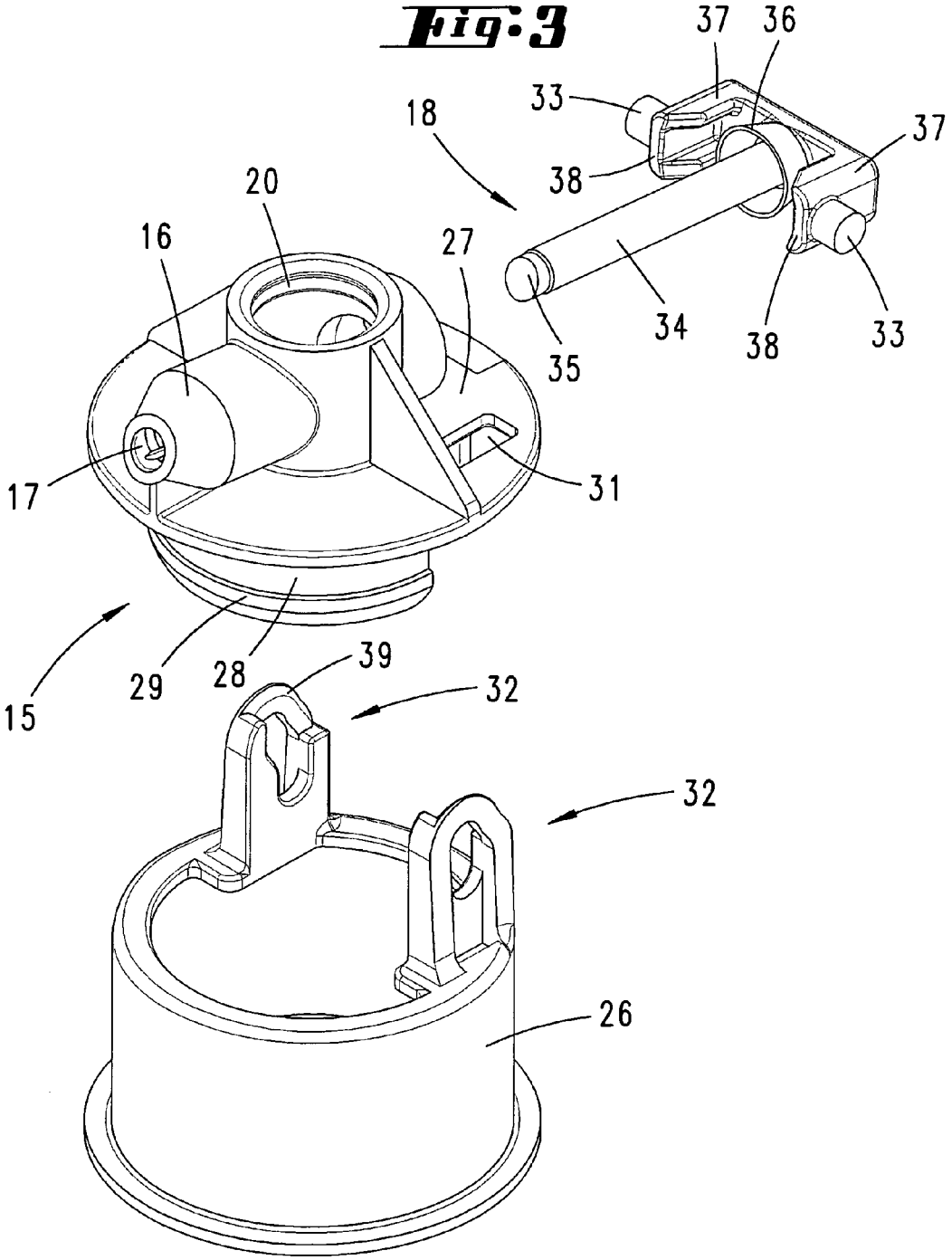
FIG. 3 shows an exploded illustration of parts of the dispenser.

As also shown in FIG. 3, the discharge part 15 has two through openings 31, through which the sliding block formations 32 pass in the assembled state. The sliding blocks 33, which are integrally molded onto the closure part 18, run in the sliding block formations 32 that form the slide guides. The sliding block formations 32 thus in particular form the stationary dispenser part. The closure part 18 in particular comprises a cylindrical part 34 which at its front forms the closing stopper 35 for the dispensing opening 17. An apron-like sealing lip 36 is provided at the rear, and is movable with a sealing effect in the corresponding opening of the discharge tube or the discharge part 15.

A T-section 37, which also has two protrusions 38 extending opposite one another on both sides in the direction of the cylindrical part 34, is connected to the sealing lip 36 on the outside. The mentioned sliding blocks 33 are integrally molded onto these protrusions 38, opposite and facing away from one another.

The sliding block formations 32 have insertion bevels 39 at the top, which reduce the wall thickness, to thereby permit vertical assembly of the discharge part 15, which together with the closure part 18, is already complete.

Figure 4:
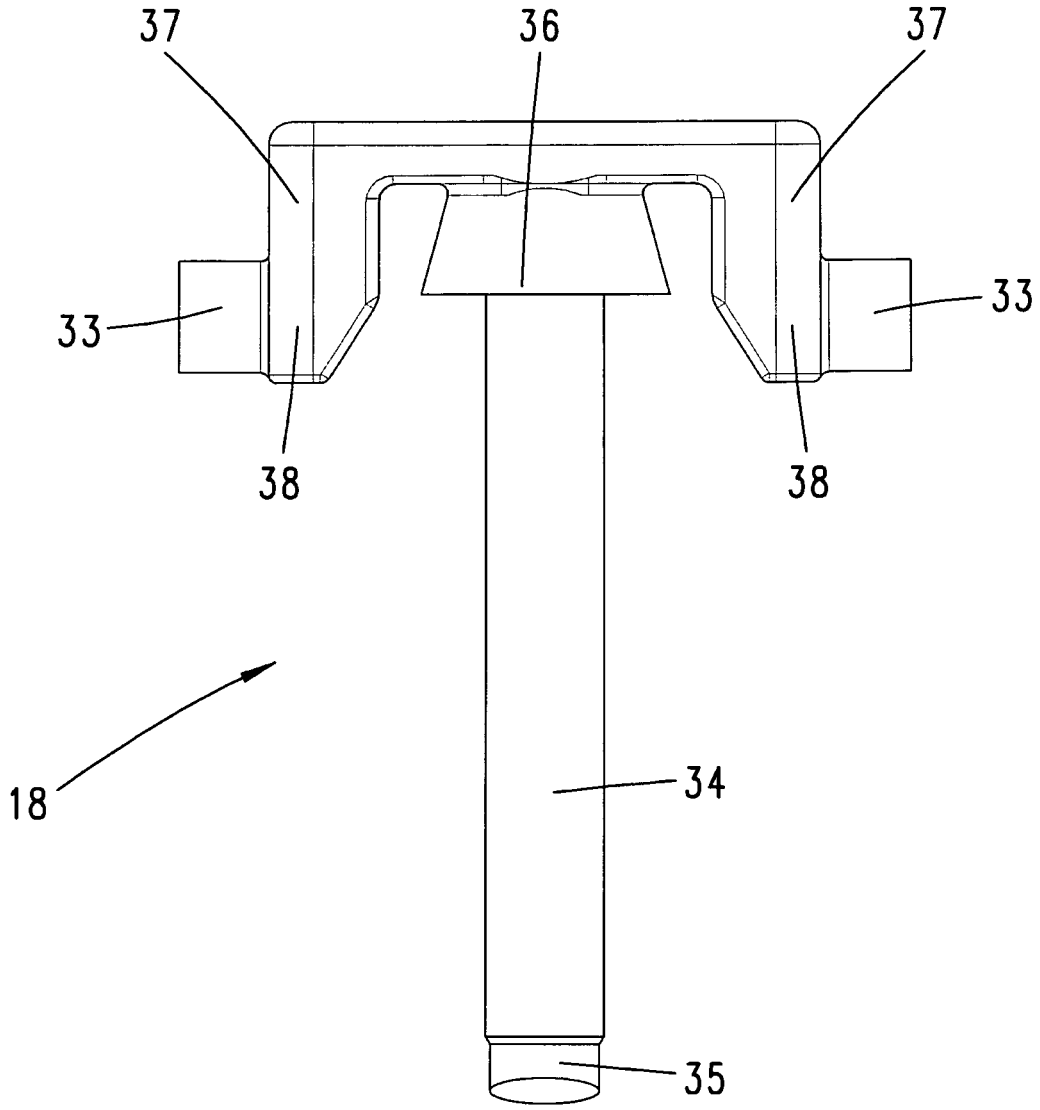
FIG. 4 shows a top view of the closure part.

The configuration of the closure part 18 is also shown in detail again in the top view according to FIG. 4.

All features disclosed here are (in themselves) pertinent to the invention. The disclosure content of the associated/accompanying priority documents (copy of the prior application) is also hereby included in full in the disclosure of the application, including for the purpose of incorporating features of these documents in claims of the present patent application. The subsidiary claims in their optional subordinated formulation characterize independent inventive refinement of the prior art, in particular to undertake divisional applications based on these claims.

List of reference numerals/characters

| | |
|---|---|
| 1 | Dispenser |
| 2 | Storage container |
| 3 | Part |
| 4 | Pump chamber |
| 5 | Pump plunger |
| 6 | Wall |
| 7 | Inlet valve |
| 8 | Valve diaphragm |
| 9 | Stopper part |
| 10 | Opening |
| 11 | Storage space |
| 12 | Outlet valve |
| 13 | Holding part |
| 14 | Outlet openings |
| 15 | Discharge part |
| 16 | Discharge tube |
| 17 | Dispensing opening |
| 18 | Closure part |
| 19 | Insertion opening |
| 20 | Additional opening |
| 21 | Detent part |
| 22 | Dispenser cap |
| 23 | Tube part |
| 24 | Opening |
| 25 | Restoring spring |
| 26 | Guide part |
| 27 | Flange portion |
| 28 | Holding portion |
| 29 | Retaining lug |
| 30 | Holder protrusion |
| 31 | Through opening |
| 32 | Sliding block formation |
| 33 | Sliding block |
| 34 | Cylindrical part |
| 35 | Closing stopper |
| 36 | Sealing lip |
| 37 | Valve portion |
| 38 | Protrusion |
| 39 | Insertion bevel |
| A | Dispenser longitudinal axis |

The invention claimed is:

1. A dispenser for discharging liquid-to-pasty compositions, comprising, a pump chamber (4) and a restoring spring (25) and a discharge part (15) which forms a discharge tube (16), the discharge tube (16) having a dispensing opening (17) which opens laterally with respect to a dispenser longitudinal axis (A) extending in a pump direction, and a closure part (18) being movable between a closed position and a release position in the discharge tube (16) for closing the dispensing opening (17), wherein an additional opening (20) which opens in the direction of the longitudinal axis (A) is formed in a top portion of the discharge part (15) and is closed by a detent part (21), wherein the additional opening is in fluid connection to the pump chamber.

2. The dispenser according to claim 1, wherein the dispenser has a dispenser cap (22) which engages over the discharge part (15).

3. The dispenser according to claim 1, wherein a dispenser cap (22) forms the detent part (21) which closes the additional opening (20).

4. The dispenser according to claim 1, wherein the additional opening (20) is formed above the closure part (18).

5. The dispenser according to claim 1, wherein the additional opening (20) has an inside diameter that matches the inside diameter of the discharge part (15) beneath the closure part (18).

6. A dispenser for discharge of liquid-to-pasty compositions, comprising, a restoring spring (25), a pump chamber (4), and a discharge part (15) which forms a discharge tube (16) and has a dispensing opening (17), wherein a closure part (18) is mechanically positively controlled by means of a stationary dispenser part between a closed position and a release position in the discharge tube (16) for closing the dispensing opening (17), wherein the restoring spring (25) is situated with respect to a pump direction radially outside to the stationary dispenser part.

7. The dispenser according to claim 6, wherein the positive control is provided by an interaction of one or more sliding blocks (33) with one or more slide guides.

8. The dispenser according to claim 6, wherein the stationary dispenser part (26) forms a guide part for the restoring spring (25).

9. The dispenser according to claim 6, wherein the stationary dispenser part (26) has a cylindrical portion.

10. The dispenser according to claim 9, wherein the cylindrical portion forms a partial guide surface for the restoring spring (25).

11. The dispenser according to claim 9, wherein a bottom of the cylindrical portion merges into an outwardly protruding flange.

12. The dispenser according to claim 11, wherein the flange forms a support surface for the restoring spring (25).

13. The dispenser according to claim 6, wherein the stationary dispenser part (26) has a radially inwardly extending flange.

14. The dispenser according to claim 7, wherein the one or more slide guides for displacing the discharge tube (16) is supported on a flange.

15. The dispenser according to claim 6, wherein the discharge part (15) has a through opening (31).

16. The dispenser according to claim 15, wherein a slide guide part passes through the through opening (31) in the assembled state of the dispenser.

17. A dispenser for discharging liquid-to-pasty compositions, comprising, a pump chamber (4) and a restoring spring (25) and a discharge part (15) which forms a discharge tube (16), the discharge tube (16) having a dispensing opening (17) which opens laterally with respect to a dispenser longitudinal axis (A) extending in a pump direction, and a closure part (18) being movable between a closed position and a release position in the discharge tube (16) for closing the dispensing opening (17), wherein an additional opening (20) which opens in the direction of the longitudinal axis (A) is formed in a top portion of the discharge part (15) and is closed by a detent part (21);

wherein the additional opening (20) has an inside diameter that matches the inside diameter of the discharge part (15) beneath the closure part (18).

* * * * *